US007967414B2

(12) United States Patent
Schmitt

(10) Patent No.: US 7,967,414 B2
(45) Date of Patent: Jun. 28, 2011

(54) INK-JET PRINT HEAD

(75) Inventor: Peter Schmitt, Würzburg (DE)

(73) Assignee: KBA-Metronic GmbH, Veitschochheim (DE)

( * ) Notice: Subject to any disclaimer, the term of this patent is extended or adjusted under 35 U.S.C. 154(b) by 425 days.

(21) Appl. No.: 12/274,618

(22) Filed: Nov. 20, 2008

(65) Prior Publication Data

US 2009/0128607 A1 May 21, 2009

(30) Foreign Application Priority Data

Nov. 20, 2007 (DE) ..... 10 2007 055 599

(51) Int. Cl.
*B41J 2/14* (2006.01)

(52) U.S. Cl. ..... 347/47; 347/49

(58) Field of Classification Search ..... 347/40, 347/43, 47, 49, 42, 13
See application file for complete search history.

(56) References Cited

U.S. PATENT DOCUMENTS 5,971,522 A * 10/1999 Ono et al. ..... 347/40

FOREIGN PATENT DOCUMENTS

DE 4033816 10/1990

* cited by examiner

*Primary Examiner* — Lamson D Nguyen
(74) *Attorney, Agent, or Firm* — Andrew Wilford

(57) ABSTRACT

An ink-jet printer head has a plurality of print modules each having a tip formed with a respective nozzle orifice from ink droplets can be projected. A flexibly deformable mounting element has a plurality of seats each holding a respective one of the tips so that the element can be deformed to fit a substrate to be printed. The mounting element is readily deformable so that the print modules can be oriented to fit the substrate being printed.

17 Claims, 3 Drawing Sheets

INK-JET PRINT HEAD

FIELD OF THE INVENTION

The present invention relates to an ink-jet printer. More particularly this invention concerns an ink-jet print head having multiple nozzles.

BACKGROUND OF THE INVENTION

Labeling products by means of freely programmable labeling systems has been known for a long time, and is used industrially in many areas. For example, ink-jet printers, among other things, are used for a plurality of applications. They allow labeling of products without contact, in that ink droplets are ejected from one or a plurality of nozzles of a print head, in such a manner that a print image in the form of a dot matrix can be built up on the surface to be imprinted.

In this connection, essentially two technologies are known: continuous ink jet and drop-on-demand technology.

In the continuous ink jet technology, an ink jet that exits continuously, in most cases from a single nozzle, is modulated by means of a modulation element for producing print variations, for example by means of a piezo oscillator, in such a manner that the jet breaks up into individual droplets having essentially the same size after it exits from the nozzle at a certain spacing from the nozzle. The ink droplets formed in this way can be charged electrostatically with different charges immediately before they separate from the ink jet, and can then be deflected by an electrical field of a downstream plate capacitor to an extent related to their respective electrostatic charges, thereby resulting in different flight paths for the ink droplets at least in terms of one deflection direction.

In this way, it is possible to select different positions of the ink droplets that have different charges at least in a direction crosswise to the direction of spread of the ink droplets, thereby making it possible to produce a print image composed of dots if a substrate to be labeled is moved simultaneously and synchronously relative to the print head.

Since this working principle also functions with a significant spacing between the print head and the surface to be imprinted and with good image good quality, it is also possible to label moderately textured surfaces, for example. However, it is a disadvantage that the maximal height of a print line produced in this way can amount to only approximately 10 mm to 20 mm, due to system conditions, and therefore it is not possible, for example, to produce a larger imprint with only a single print head, or to label of a pipe or cable, for example, in such a manner that the outer surface of the pipe or cable can be imprinted in an angle range of more than 120°, or actually in an angle range of 360°.

In these cases, it is necessary to use multiple print heads and/or printing systems, and to mount them, for example in a circle around the object to be imprinted for 360° imprinting, the print image being divided up among the number of printing systems used that must be operated synchronously. Of course, such a method is complicated, error-prone, and expensive.

In contrast to the continuous ink-jet method, a print head of a drop-on-demand printing system has a plurality of individual nozzles that can be controlled independently of one another. The nozzles are generally oriented in a line in a nozzle plate, and have the same spacing from one another, in each instance.

The production of individual ink droplets takes place, according to this principle, in that each nozzle, together with a respective nozzle chamber and a respective modulation element forms a separate print module that can be controlled independently. For this purpose, all the nozzle chambers of a print head are connected with a common ink reservoir by way of common ink feed lines, for example, so that in operation the nozzle chambers are all filled with ink.

In this connection, the modulation elements are mounted on the respective nozzle chambers such that they can build up an excess pressure in the respective nozzle chambers in pulse-like manner, where corresponding electrical control occurs, thereby causing an ink droplet to be expelled to the outside from the respective nozzle. Because the print modules can essentially be controlled independently of one another, it is possible to produce a complete print line with a single common control pulse, where the control pulse triggers all the required nozzles at the same time, by way of corresponding control circuits.

Depending on the type and embodiment of the print heads, the print chambers are connected with one another by way of the above-described ink feed line, and furthermore the nozzles can be controlled to produce droplets only in specific groupings, depending on the method of operation of the modulation elements, in that the nozzles 1, 4, 7, . . . are turned on with a first print pulse, for example, the nozzles 2, 5, 8, . . . are turned on in a second print pulse, and the nozzles 3, 6, 9, . . . are turned on in a third print pulse, thereby resulting in a saw-tooth-like print line when an object to be imprinted moves continuously past the print head.

As a condition of the system, it is not possible to produce high-quality imprinting over a greater distance, for example on a curved or textured surface of a product, using drop-on-demand print heads, since the ink droplets produced using this method have a relatively low ejection speed and a small diameter, and therefore a small mass, and thus can be deflected from their flight path in uncontrolled manner, after only a short flight distance, due to air resistance and external air movements such as those that result from movement of the object to be imprinted, and therefore a deterioration of the print image occurs that increases with spacing.

However, since it is generally desired to achieve high print quality, it is furthermore necessary to make available a large number of print channels, and, at the same time, the spacing between adjacent nozzles must be small, and the ink droplets that are ejected must be small. Technically, this is accomplished in that a complete print head is built up more or less monolithically, in that all the nozzle chambers, their corresponding ink feed lines, and the modulation elements are combined in a common base body, for example, and form a rigid block. Such print heads that work according to the drop-on-demand method are manufactured and sold by the companies Spectra, Xaar, Konika Minolta, Hewlett Packard, or Epson Industrial, for example.

However, it is a disadvantage of the above-described print heads that surfaces having a significant curvature can only be imprinted unsatisfactorily, or not at all, in a single work step, or only using a plurality of print heads, and this means a high investment.

In German patent document 40 33 816, in contrast, a flexible print head is described with which it is possible to imprint a curved surface within over part of its curvature, but the shape of the print head is adjustable only as an arc over a fixed center point, and thus only with a curvature in one plane, and therefore it is not suitable for imprinting surfaces having a different shape. Furthermore, 360° imprinting is not possible with such a print head.

OBJECTS OF THE INVENTION

It is therefore an object of the present invention to provide an improved ink-jet print head.

Another object is the provision of such an improved ink-jet print head that overcomes the above-given disadvantages, in particular with which it is possible to imprint the surface of a shaped body, essentially independently of the shape of the surface of the body, along a predetermined direction, without turning the body or the print head during the imprinting process.

SUMMARY OF THE INVENTION

An ink-jet printer head has a plurality of print modules each having a tip formed with a respective nozzle orifice and means for ejecting ink droplets from the respective orifice. A flexibly deformable mounting element has a plurality of seats each holding a respective one of the tips so that the element can be deformed to fit a substrate to be printed. The mounting element is readily deformable so that the print modules can be oriented to fit the substrate being printed.

Thus, the print head has a plurality of individual print modules that can be controlled essentially independent of one another or also together, and can be combined in such a manner that the nozzle apertures of the print modules form a common nozzle arrangement. In this connection, the nozzle arrangement can be structured in such a way that the nozzles of the print modules lie on a common nozzle surface that can be configured in three dimensions, particularly can be curved in multiple dimensions, or can be bent, while remaining at a fixed spacing from one another, essentially independent of the shape of the nozzle surface.

In this connection, the arrangement of the print modules relative to a nozzle surface can be configured in such a manner that the nozzles of the print modules form are arrayed in a line or over a two-dimensional area.

In order to be able to adapt the nozzle surface formed in this manner to the requirements of labeling product surfaces having different shapes, according to the invention the nozzles of the print modules, i.e. the end regions of the print modules that have at least one nozzle, and thus at least the so-called nozzle plates of the print modules, are held in a mounting device consisting of an elastomer material, particularly a rubber-like material, to produce a specific nozzle surface.

In this way, it is possible to adapt the nozzle surface formed in this way to a surface of a three-dimensionally configured product to be labeled, for example the surface of a cylindrical product, because of the flexibility of the material of the mounting device, in such a manner that all the nozzles have essentially the same spacing from the surface of the product, so that a uniform print quality can be achieved, independent of the imprinting distance. In this connection, an elastomer that has isotropic properties with regard to its flexibility can preferably be selected for the mounting device.

Using such a mounting device, it is also possible to deform the nozzle surface into a ring or circle, that is 360°, and/or to additionally twist it, in order to form a circle or a spiral, for example, thereby making it possible to imprint a cylindrical product, for example, completely over its outside face, or, in the case of a tubular substrate on its inside face.

In this connection, each individual print module can comprise a basic body, for example, which has an ink feed line, an ink chamber having a subsequent nozzle aperture, as well as electrical control elements for producing an individual ink droplet, and electrical connection elements for a connection to a controller.

According to the invention, the individual print modules can be connected with one another, for example, by means of the above-described mounting device, or, in general, a flexible and/or deformable material, in such a manner that their nozzle plates form a common surface in a basic position, and their nozzles are arrayed along a line, for example, or form a line, thereby making it possible to bring the row of nozzles created in this manner into any desired shape, by means of deforming the flexible and/or deformable material, for example to shape it into a circle or arc, or deform it into a spiral or into a serpentine line. This basic position can thus be understood to mean an arrangement of the nozzle modules relative to one another that they automatically assume, without any deforming forces. Thus, the material used can be elastic, and be automatically resettable with regard to its shape.

According to the invention the print modules are connected among one another by means of a plastically deformable, particularly a thermoplastic material, so that it is possible to form a specific three-dimensional nozzle arrangement, for example, in that the thermoplastic material, for example, can be brought into a deformable state by heating it, so that it can be assume a desired shape. Subsequent cooling permanently fixes the material in place, for example. Depending on the material used, the deformation can be irreversible, for example, or can be reversible by reheating the material.

According to the invention the row of nozzles can be twisted about an axis, for example along its longitudinal axis, particularly, therefore, about the axis along which the nozzle plates are disposed one behind the other, thereby causing the ejection directions of the ink droplets from the nozzles to point in different directions, radially outward, from the longitudinal axis, in order to thereby imprint the interior of a hollow body, for example, in whole or in part.

In accordance with the invention it is possible to deform the row of nozzles about a working axis that lies perpendicular to, for example, and particularly at a spacing from the longitudinal axis of a row of nozzles, thereby causing the ejection directions of the ink droplets from the nozzles to point radially inward, relative to the working axis mentioned as an example, in order to thereby imprint the exterior of a body, for example, in whole or in part. In this case all the nozzles can in effect be aimed at a common point.

Deforming the row of nozzles about a working axis that lies perpendicular to, for example, and particularly at a spacing from the longitudinal axis of a row of nozzles, causes the ejection directions of the ink droplets from the nozzles to point radially outward, relative to the working axis mentioned as an example, in order to thereby imprint the interior of a body, for example, in whole or in part.

The modules can according to the invention be equipped with valves, for example kick-back valves or with pumps, for example micro-pumps in their ink supply lines and/or ink reservoirs thereby causing mechanical pressure variations in a common ink feed system, for example, not to be transferred to the print modules, and therefore the operational reliability of such a print head increases significantly as a result.

Furthermore, in this way it is possible to empty or fill individual print modules with ink, in simple manner, so that individual print modules can be replaced for service purposes, for example, without impairing the functionality of the other print modules. Furthermore, it is also possible to eject a specific amount of ink for nozzle cleaning of individual nozzles, in a targeted manner, thereby making it possible to eject air or disruptive contaminants form the nozzle in targeted manner.

A print head according to the invention can be composed, as described above, of a number of individual print modules. In this connection, it is unimportant for the invention whether the individual print modules represent valves that can be controlled merely electrically or pneumatically, or whether each individual print module represents a separate print head having at least one nozzle.

The individual print modules can be connected with one another, preferably along a longitudinal axis, using a deformable material, for example by means of a rubber material, or, for example, by means of a thermoplastic material, or, for example, by way of one or more spring elements to which the individual print modules are attached.

Since the print modules must be supplied with ink or another agent to be imprinted, the supply with these agents can take place, according to the invention, by way of individual external feed lines, for example, or by way of a common feed line, if the print modules and the connection material are structured accordingly.

In a preferred embodiment, when using the described elastomer connection, particularly a rubber-like connection, this can take place via passages formed in the elastomer material, where this material, at the same time, has the function of a supply system and/or reservoir for the agent, particularly the ink.

Accordingly, when using one or more coil springs as connection elements, these can be configured to be hollow, and thus also serve as ink-supply hoses. It is practical if the required electrical feed lines to the individual print modules are passed to common control electronics and/or an controller by means of cables, in each instance.

When using inks, these can represent usual low-viscosity oil-based printing inks, for example, or UV-hardening printing inks, but also other low-viscosity liquids such as adhesives or oils or reaction liquids, for example, depending on the requirements. If the print modules also have valves and/or pumps, for example micro-pumps, known problems with outside air in the feed lines are eliminated in this way, when using the above-described inks to be imprinted, on the one hand, since this air is effectively transported out of the ink system by means of the transport effect of the above-described pumps, and the nozzle elements thus can have a self-cleaning function. Also, there is the additional possibility of transporting gases instead of liquids, particularly reactive gases, and of bringing them to individual positions of a surface within a production process, in targeted and metered manner, in order to trigger, prevent, or support chemical or physical reactions, for example.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
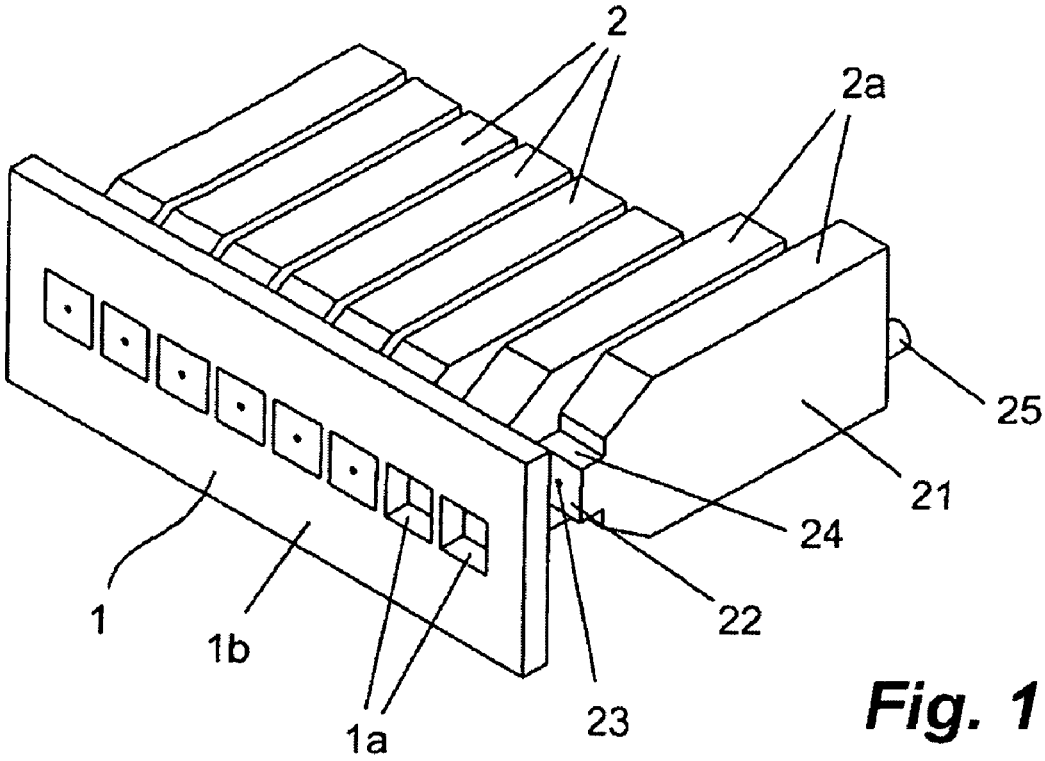
FIG. 1 is perspective front view of a first ink-jet print head according to the invention.

As seen in FIG. 1 a first embodiment of a print head according to the invention has a mounting plate 1 consisting of a flexible material, for example an elastomer, formed with a number of throughgoing square mounting apertures 1*a* for accommodating print modules 2 that can be controlled independent of one another. The mounting plate 1 forms the mounting device mentioned above, and can have a thickness, here in a preferred embodiment, such that it is largely self-supporting, in other words does not significantly deform under the effect of gravity, but only as the result of externally applied forces.

In this connection, the apertures 1*a* can be structured so that complementary square tips 24 of the print modules 2 fit snugly into the apertures 1*a* and are in fact tightly held in them, for example, something that is easily possible when using a rubber-like material for the mounting plate. Alternatively or also in addition to this, corresponding attachment devices, not shown, can be provided on the mounting device 1 in order to hold the print modules 2 in place in their apertures 1*a* independent of any deformation of the mounting plate 1 required for a specific use. It is also possible to glue the print modules 2 into their mounting apertures 1*a*.

Furthermore according to the invention thickness of the plate 1 and the length of the tips 24 is such that when the print modules 2 are fitted to the plate 1 their planar front end faces 22 are flush with the respective front face 1*b* of the plate 1. The face 1*b* lies in a plane when the plate 1 is not deformed. The bodies 21 of the print model press directly against the back face 1*e* of the mounting plate 1, which face 1*e* is also planar in a relaxed condition of the plate 1. The apertures 1*a* are equispaced in a straight line in the relaxed condition shown in FIGS. 1 and 2 of the plate 1.

Figure 3:
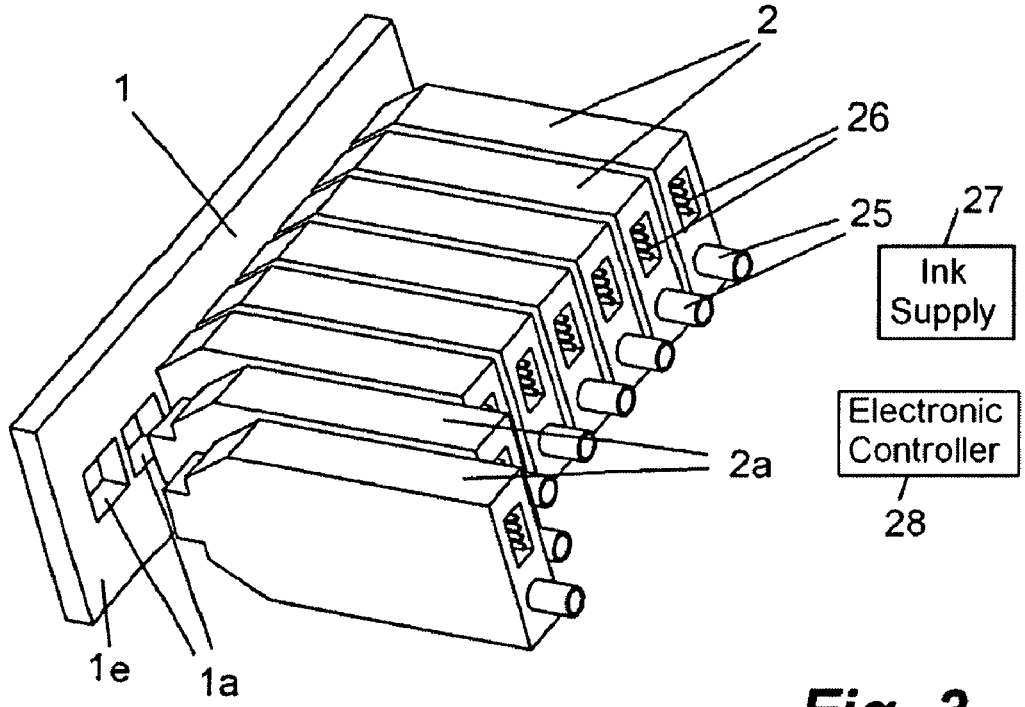
FIG. 3 is a rear view of the print head according to the invention, this view being identical for the first and second embodiments of FIGS. 1 and 2.
Figure 6:
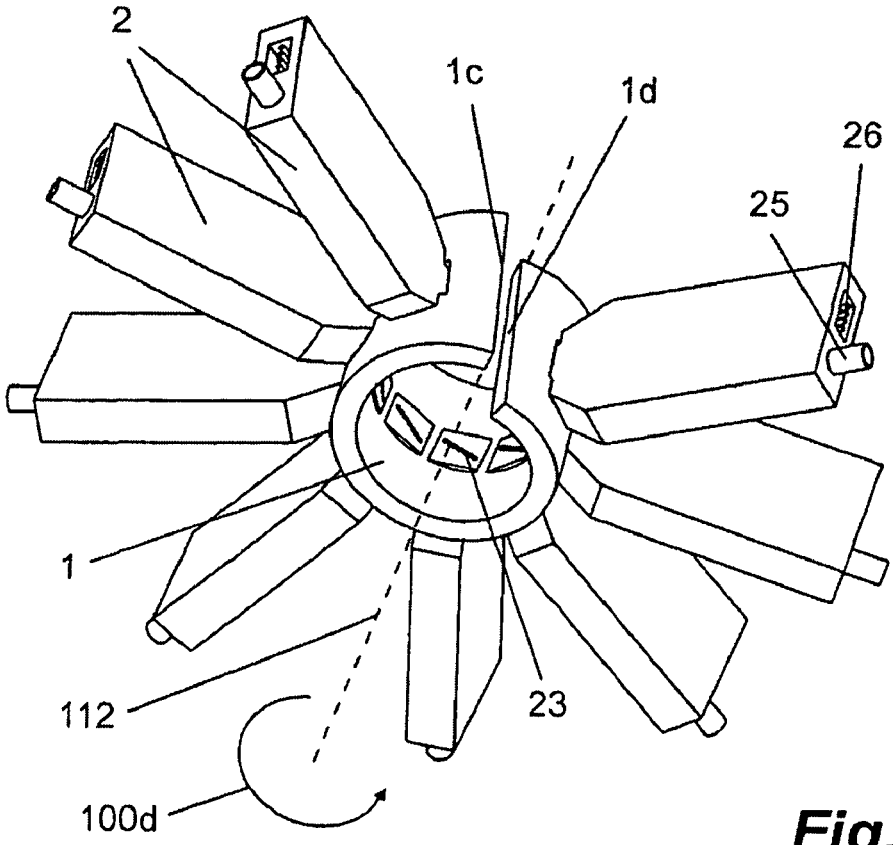
FIG. 6 is another perspective view showing the second print head in yet another configuration.

According to the invention, the print modules 2 can each consist of the body 21, for example, in which a micropump, a valve, an ink filters, pressure production elements, ink feed lines, and, if necessary, electronic control circuits constituting means for projecting ink droplets can be provided. As shown in FIGS. 3 and 6, the rear end of each body 21 is provided with an electrical connector 26, here a multicontact socket, and an intake nipple or fitting 25 for connection to a common electronic controller 28 and via a manifold to a common ink supply 27 (FIG. 3). Each of the bodies 21 has a pair of flat planar and parallel side faces and is of the same width between these side faces as the respective aperture 1*a* so that, when the nozzle tips 22 are fitted to the respective apertures 1*a* the side faces are spaced apart by a distance equal to the spacing between the adjacent apertures 1*a*, that is the thickness of the webs separating them.

Each of the nozzle plates or front-end faces 22 of each print module 2 can have a single nozzle orifice 23 (FIG. 1) or a row of such orifices 23 (FIGS. 2, 5, and 6), here with the row extending diagonally. Depending on the type and embodiment of the print modules 2, in this connection the individual nozzle orifices 23 of each print head 2 can be operated by the controller 28 in groups, or independently of one another. The face 1*b* with the flush nozzle faces 23 forms a common nozzle plate. The flexibility of the material of the mounting plate 1 used as the nozzle plate makes the common nozzle plate 1*b* deformable.

Figure 2:
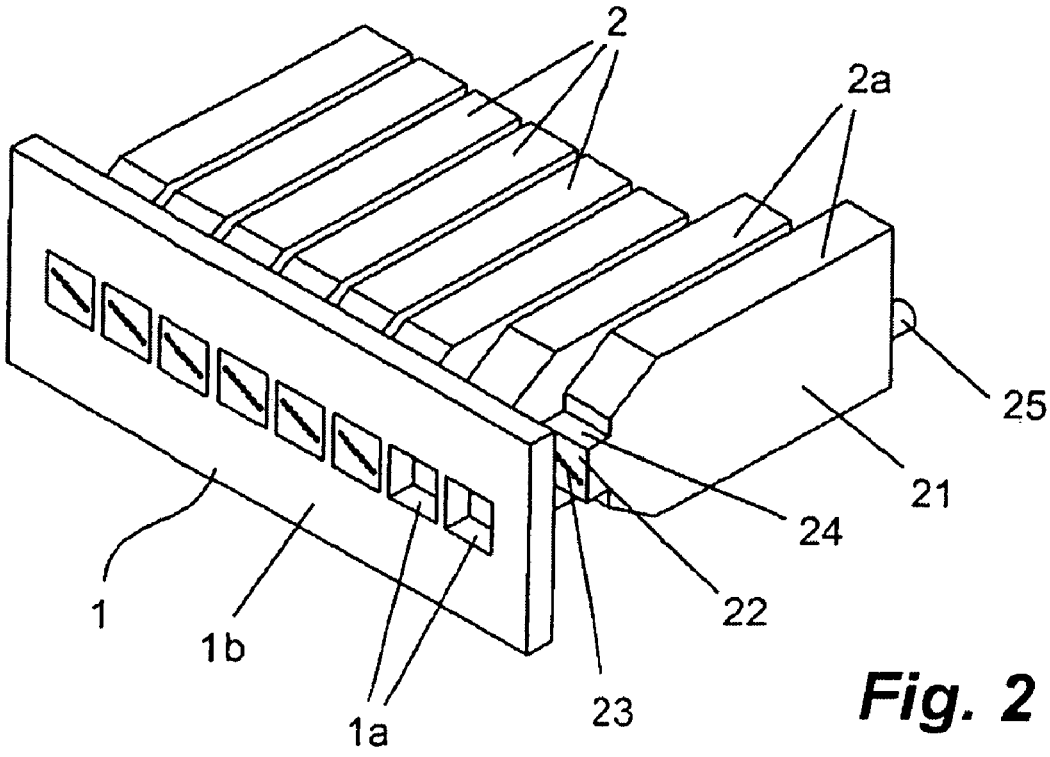
FIG. 2 is a similar view of a second print head according to the invention.

FIGS. 1 and 2 furthermore schematically show the possibility of replacing individual print modules 2 in that individual print modules 2*a*, for example, can be removed from the common mounting device 1, or added to it, respectively. Thus failure or clogging of a single print module 22 can be fixed with a simple replacement of this cheap mass-produced element.

A rear view of an embodiment of a print head according to the invention, having multiple individual print modules 2 according to FIG. 1 or FIG. 2, is shown in FIG. 3. In this connection, the individual print modules 2 have electrical connectors 26 for connection to the electronic controller 28. The supply of ink takes place by way of the feed connections 25, which can be fed from the common ink supply 27. It is also possible, according to the invention, to supply different print modules with different inks from different ink reservoirs, thereby making it possible to produce different printing with different ink colors in different regions, in a single work step, in the case of an all-around imprinting of a cylindrical material to be imprinted, for example, such as a cable or a pipe, for example.

Figure 4:
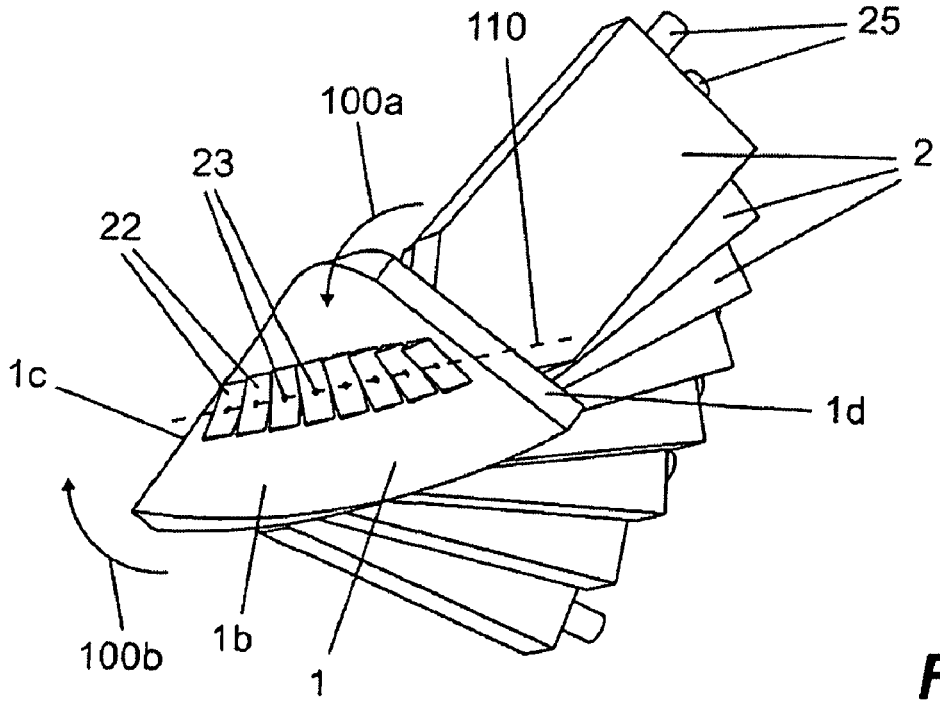
FIG. 4 is a view like FIG. 2 showing the second print head in another configuration.

FIG. 4 shows, as an example, a first possible deformation of a print head according to the invention, for example for imprinting a concave formation of an object to be imprinted. For this purpose, end faces 1*c* and 1*d* of the mounting plate, for example, are twisted relative to one another, along a longitudinal axis 110 formed by the nozzle arrangement of the print modules 2 counter to a direction of rotation 100*a* or 100*b* in such a manner that the desired nozzle arrangement and a desired ejection direction of the ink droplets from the nozzles 23 can form. In this connection, this longitudinal axis 110 preferably runs precisely through the centers of the nozzle faces 23.

Figure 5:
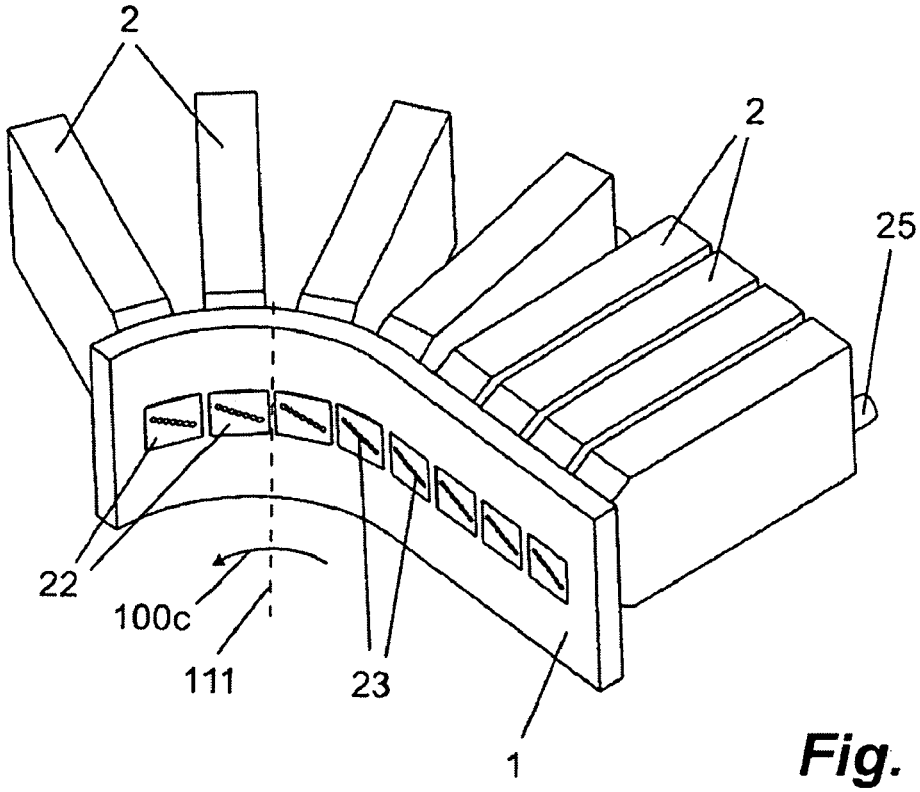
FIG. 5 is a view of a possible deformation of a printhead according to the present invention.

Another possible deformation of a print head according to the invention is shown in FIG. 5, where in this deformation of the mounting plate 1, shown as an example, only part of the mounting plate 1 is deformed, here arched circularly about an axis 111 formed by the nozzle arrangement of the print modules, in the direction 110*c*, thereby making it possible to imprint a rounded-off edge of an object to be imprinted.

Another possible deformation of a print head according to the invention is shown in FIG. 6, where in this deformation of the mounting plate 1, shown as an example, this plate 1 is for about and perpendicular to an axis 112 formed by the nozzle arrangement of the print modules, for example, essentially in a circle in the direction 100*d*, and where in particular, here the end faces 1*c* and 1*d* are juxtaposed but somewhat offset so that the mounting plate 1 is deformed in essentially spiral-shaped manner. In this way, it is possible, for example, to provide a cylindrical material to be imprinted, such as cables or pipes, for example, with an all-around imprinting in a single work step.

With regard to all the embodiments, it should be stated that the technical characteristics mentioned in connection with an embodiment can be used not just for the specific embodiment, but also in the other embodiments. All the technical characteristics disclosed in the description of this invention should be classified as being essential to the invention, and can be combined with one another in any way desired, or can be used alone.

I claim:

1. An ink-jet printer head comprising:

a plurality of print modules each having a tip formed with a respective nozzle orifice and means for ejecting ink droplets from the respective orifice; and a flexibly deformable mounting element having a plurality of seats each holding a respective one of the tips, whereby the element can be deformed to fit a substrate to be printed.

2. The ink-jet printer head defined in claim 1, further comprising an ink supply connected to all of the modules.

3. The ink-jet printer head defined in claim 2 wherein the ink supply holds inks of different colors and feeds different colors to different modules.

4. The ink-jet printer head defined in claim 1 wherein the mounting element is an elastomer.

5. The ink-jet printer head defined in claim 4 wherein the elastomer is rubber, silicone, or acrylic.

6. The ink-jet printer head defined in claim 1 wherein the mounting element includes a spring.

7. The ink-jet printer head defined in claim 6 wherein the spring is tubular and feeds ink to the print modules.

8. The ink-jet printer head defined in claim 1 wherein the mounting element is thermoplastically deformable.

9. The ink-jet printer head defined in claim 8 wherein the thermoplastic deformability of the material is reversible.

10. The ink-jet printer head defined in claim 1 wherein the mounting element is deformable into an annular shape.

11. The ink-jet printer head defined in claim 10 wherein the print orifices are all directed generally at a common point.

12. The ink-jet printer head defined in claim 1 wherein each module includes a respective individually controllable valve.

13. The ink-jet printer head defined in claim 1 wherein the print modules are releasably retained in the respective seats.

14. The ink-jet printer head defined in claim 1 wherein the elastomer is formed with passages through which ink is fed to the print modules.

15. An ink-jet printer head comprising:

an elastomeric plate formed with a row of identical throughgoing apertures, the plate being deformable into a shape with the row extending along an arc, a spiral, or a circle;

a plurality of identical print modules each having a tip complementary to and fitted snugly in a respective one of the apertures, each tip having at least one nozzle opening, each module having means for projecting ink droplets from the respective nozzle opening.

16. The ink-jet printer head defined in claim 15 wherein the plate has a thickness and the modules have large bodies from which the tips extends and each tip has a length substantially equal to the plate thickness such that, when the tips are fitted to the plate with the bodies bearing on a back face of the plate, front faces of the tips are flush with a front face of the plate.

17. The ink-jet printer head defined in claim 15 wherein the apertures are arrayed in a line and have a center-to-center spacing equal to more than a thickness of the bodies of the modules.

* * * * *